US007642028B2

(12) United States Patent
Wu et al.

(10) Patent No.: US 7,642,028 B2
(45) Date of Patent: Jan. 5, 2010

(54) IMAGING MEMBERS

(75) Inventors: Jin Wu, Webster, NY (US); Liang-Bih Lin, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 246 days.

(21) Appl. No.: 11/227,564

(22) Filed: Sep. 15, 2005

(65) Prior Publication Data

US 2006/0210894 A1 Sep. 21, 2006

Related U.S. Application Data

(60) Provisional application No. 60/662,759, filed on Mar. 17, 2005.

(51) Int. Cl.
*G03G 5/047* (2006.01)
*G03G 5/147* (2006.01)
*G03G 5/05* (2006.01)

(52) U.S. Cl. ..... 430/58.2; 430/59.6; 430/66; 430/58.8; 430/58.75

(58) Field of Classification Search ..... 430/58.2, 430/66, 59.6, 67
See application file for complete search history.

(56) References Cited

U.S. PATENT DOCUMENTS

| | | | | |
|---|---|---|---|---|
| 3,837,851 | A | | 9/1974 | Shattuck et al. |
| 4,081,274 | A | | 3/1978 | Horgan |
| 4,115,116 | A | | 9/1978 | Stolka et al. |
| 4,233,384 | A | | 11/1980 | Turner et al. |
| 4,265,990 | A | | 5/1981 | Stolka et al. |
| 4,278,746 | A | | 7/1981 | Goto et al. |
| 4,286,033 | A | | 8/1981 | Neyhart et al. |
| 4,291,110 | A | | 9/1981 | Lee |
| 4,298,697 | A | | 11/1981 | Baczek et al. |
| 4,299,897 | A | | 11/1981 | Stolkat et al. |
| 4,304,829 | A | | 12/1981 | Limburg et al. |
| 4,306,008 | A | | 12/1981 | Pai et al. |
| 4,315,982 | A | | 2/1982 | Ishikawa et al. |
| 4,338,387 | A | | 7/1982 | Hewitt |
| 4,338,390 | A | | 7/1982 | Lu |
| 4,346,158 | A | | 8/1982 | Pai et al. |
| 4,560,635 | A | | 12/1985 | Hoffend et al. |
| 4,654,284 | A | | 3/1987 | Yu et al. |
| RE32,883 | E | | 3/1989 | Lu |
| 5,300,392 | A | * | 4/1994 | Odell et al. ..... 430/96 |
| 6,096,464 | A | * | 8/2000 | Sundararajan et al. ... 430/58.05 |
| 6,156,468 | A | | 12/2000 | Wehelie et al. |
| 6,177,219 | B1 | | 1/2001 | Yuh et al. |
| 6,214,514 | B1 | | 4/2001 | Evans et al. |
| 6,255,027 | B1 | | 7/2001 | Wehelie et al. |
| 6,420,047 | B2 | | 7/2002 | Winckler et al. |
| 6,489,070 | B1 | * | 12/2002 | Srinivasan ..... 430/58.5 |
| 6,713,601 | B2 | | 3/2004 | Phelps |
| 6,790,573 | B2 | | 9/2004 | Drappel et al. |
| 6,800,411 | B2 | | 10/2004 | Tong et al. |
| 6,818,366 | B2 | | 11/2004 | Qi et al. |
| 6,824,940 | B2 | | 11/2004 | Wu et al. |
| 6,855,798 | B2 | | 2/2005 | Faler |
| 2004/0115546 | A1 | | 6/2004 | Tong et al. |

FOREIGN PATENT DOCUMENTS

| | | | | |
|---|---|---|---|---|
| JP | 2005077486 | A | * | 3/2005 |
| JP | 2005215308 | A | * | 8/2005 |
| JP | 2005250079 | A | * | 9/2005 |
| WO | WO 02098946 | | | 12/2002 |

OTHER PUBLICATIONS

Diamond, Arthur S & David Weiss (eds.) Handbook of Imaging Materials, 2nd ed.. New York: Marcel-Dekker, Inc. (Nov. 2001) pp. 41-403.*

English language machine translation of JP 2005-077486 (Mar. 2005).*

Partial Human translation of JP 2005-077486 (Examples only) (2005).*

* cited by examiner

*Primary Examiner*—Christopher RoDee
(74) *Attorney, Agent, or Firm*—Carter, DeLuca, Farrell & Schmidt, LLP

(57) ABSTRACT

Novel surface layers for photoreceptors are provided. The surface layers are a polymeric composition including a resin and a cyclic polymer.

10 Claims, 1 Drawing Sheet

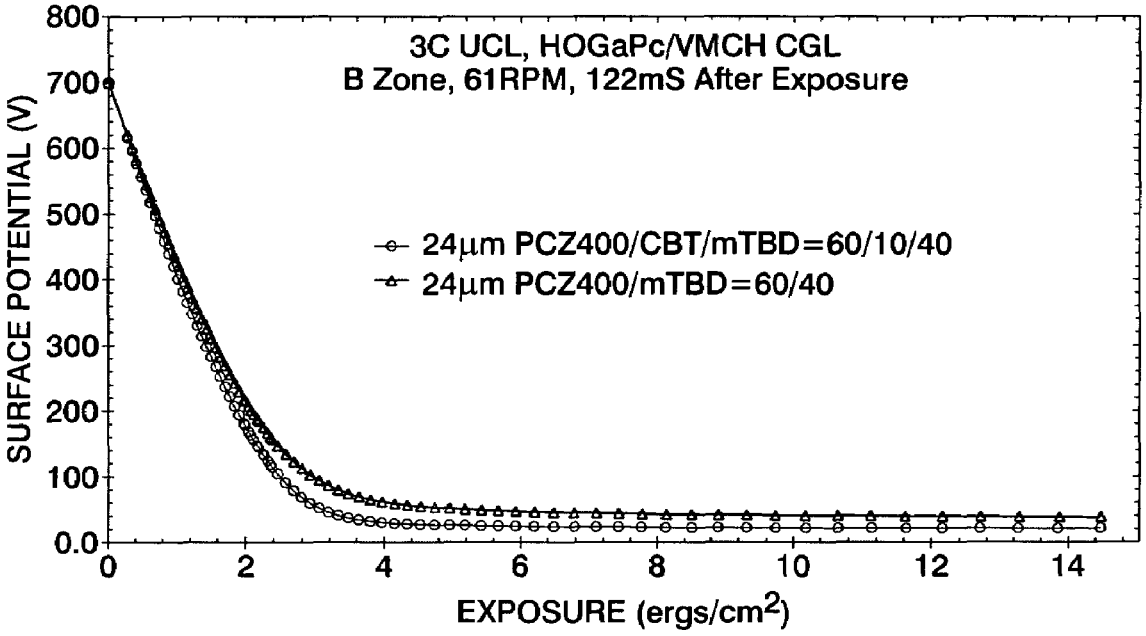
3C UCL, HOGaPc/VMCH CGL
B Zone, 61RPM, 122mS After Exposure
24μm PCZ400/CBT/mTBD=60/10/40
24μm PCZ400/mTBD=60/40
SURFACE POTENTIAL (V)
800
700
600
500
400
300
200
100
0.0
0
2
4
6
8
10
12
14
EXPOSURE (ergs/cm2)

IMAGING MEMBERS

CROSS-REFERENCE TO RELATED APPLICATIONS

This application claims the benefit of U.S. Provisional Patent Application No. 60/662,759 filed Mar. 17, 2005, the entire disclosure of which is hereby incorporated by reference herein.

BACKGROUND

This disclosure relates to imaging members and, more specifically, to imaging members having a surface layer possessing excellent charge transport properties and in embodiments resistance to wear.

In the art of electrophotography, an electrophotographic member comprising a photoconductive insulating layer on a conductive layer is imaged by first uniformly electrostatically charging the surface of the photoconductive insulating layer. The member is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles, for example, from a developer composition, on the surface of the photoconductive insulating layer. The resulting visible toner image can be transferred to a suitable receiving member, such as paper.

The imaging members, that is, photoreceptors, can take several forms, including flexible belts, rigid drums, plates, and the like. Electrophotographic photoreceptors can be prepared with either a single layer configuration or a multilayer configuration. Multilayered photoreceptors may generally include a substrate support, an electrically conductive layer, an optional charge blocking or hole blocking layer, an optional adhesive layer, a charge generating layer, a charge transport layer, and an optional protective or overcoating layer(s). In the multilayer configuration, the active layers of the photoreceptor are the charge generation layer (CGL) and the charge transport layer (CTL). For multilayered flexible photoreceptor belts, an anticurl layer can be selected for the backside of the substrate support, opposite to the side carrying the electrically active layers, to achieve the desired photoreceptor flatness.

It may be desirable to enhance charge transport in photoresponsive surface layers of photoreceptors to alter their performance characteristics. In some situations, charge transport can be achieved with high-mobility charge transport molecules, specifically also known as hole transport molecules (HTM), and/or high HTM loading in a surface layer of a photoreceptor, such as a charge transport later. Another approach to enhance transport is incorporation of a relatively non-polar polymeric component in a polymeric matrix forming a surface layer of a photoreceptor: for example, N,N'-diphenyl-N,N-bis(3-methyl phenyl)-1,1'-biphenyl-4,4'-diamine in polystyrene exhibits higher mobility than the same aryl amine molecule in polycarbonate. Drawbacks to the above approaches include difficulties with synthesis, crystallization of the HTM at high loading, and poor mechanical properties after prolonged use of the resulting surface.

In addition, wear resistance of the top surface layer may be desirable for long life photoreceptors. In some instances, wear resistance of a surface layer may be moderately improved by doping with low surface energy polytetrafluoroethylene (PTFE) micro-particles, or nanosized metal oxides such as $Al_2O_3$. However, because preparation of a dispersion to achieve such doping is difficult, homogeneous systems are sometimes selected due to their simplicity in manufacturing.

Improved methods for forming photoreceptors, including charge transport layers, remain desirable.

SUMMARY

The present disclosure provides photoconductive imaging members having a surface layer which includes at least one resin and at least one cyclic polymer. In embodiments, the at least one resin may be from about 2 to about 10 resins and the at least one cyclic polymer may be from about 2 to about 10 cyclic polymers.

Suitable resins include, for example, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, poly(cyclo olefins), polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyacrylonitriles, poly-N-vinylpyrrolidinones, acrylate copolymers, alkyd resins, cellulosic film formers, poly (amideimide), styrene-butadiene copolymers, vinylidenechloride-vinylchloride copolymers, vinylacetate-vinylidenechloride copolymers, styrene-alkyd resins, polyvinylcarbazoles, and combinations thereof. In embodiments, the resin may be a linear polycarbonate or polyarylate possessing a degree of polymerization of from about 50 to about 5,000. Suitable cyclic polymers include cyclic oligomers such as cyclic polycarbonates, cyclic copolycarbonates, cyclic polyesters and cyclic copolyesters.

In embodiments, cyclic oligomers which may be utilized include cyclic poly(1,4-butylene terephthalate), cyclic poly (1,3-propylene terephthalate), cyclic poly(1,4-cyclohexylenedimethylene terephthalate), cyclic poly(ethylene terephthalate), cyclic poly(1,2-ethylene 2,6-naphthalenedicarboxylate), cyclic poly(bisphenol A carbonate), cyclic poly(bisphenol C carbonate), cyclic poly (bisphenol E carbonate), cyclic poly(bisphenol F carbonate), cyclic poly(bisphenol M carbonate), cyclic poly(bisphenol P carbonate), cyclic poly(bisphenol S carbonate), and cyclic poly(bisphenol Z carbonate).

The thickness of the surface layer may vary depending upon whether the surface layer is an overcoat layer or a charge transport layer. In embodiments the thickness of the surface layer may be from about 0.1 microns to about 50 microns. Where the surface layer is an overcoat layer, it may have a thickness of from about 0.1 microns to about 25 microns and may include an optional hole transport molecule. Where the surface layer is a charge transport layer having at least one hole transport molecule, its thickness may be from about 2 microns to about 50 microns.

In embodiments, the photoconductive imaging members may also possess a photogenerating layer of about 15 weight percent to about 95 weight percent of a resin, about 5 weight percent to about 85 weight percent of a photogenerating component such as metal phthalocyanines, metal free phthalocyanines, alkylhydroxyl gallium phthalocyanines, hydroxygallium phthalocyanines, chlorogallium phthalocyanines, and perylenes, an optional substrate, an optional hole blocking layer, and an optional adhesive layer.

In other embodiments, the present disclosure provides a coating composition for a photoconductive imaging member comprising at least one resin and at least one cyclic polymer.

Methods for improving the charge transport characteristics of photoconductive imaging members with these resin and cyclic polymer compositions are also provided. Surface layers of the present disclosure possessing HTM may have a Vr of from about 10 V to about 80 V lower than the Vr of conventional charge transport layers, and surface layers of the present disclosure may have a wear rate of from about 40 nm/kcycle to about 80 nm/kcycle lower than the wear rate of known surface layers.

BRIEF DESCRIPTION OF THE DRAWING

The FIGURE is a graph depicting photoinduced discharge characteristics (PIDC) and $V_r$ (the residual voltage on the photoreceptor) of a photoreceptor having a surface layer made of a polymeric blend in accordance with the present disclosure compared with a control layer.

DETAILED DESCRIPTION OF THE PREFERRED EMBODIMENTS

The present disclosure provides photoresponsive imaging members having a surface layer generated from a dispersion containing polymeric compositions which, in some embodiments, may be polymeric blends. The dispersion may be utilized to form a surface layer on an imaging member.

The polymeric composition of the present disclosure includes a linear resin and a cyclic polymer. In embodiments, "cyclic polymer" refers, for example, to a polymer having no free ends due to a monomer at one end of the polymer polymerizing with a monomer at the other end of the polymer. In embodiments, "resin" and a "cyclic polymer" refer, for example, to any suitable polymer or cyclic polymer having a degree of polymerization of 2 and above, and more specifically from about 2 to about 5,000, in embodiments from about 3 to about 500, and thus can include oligomers and cyclic oligomers. For example, an oligomer or cyclic oligomer may have about 50 or less repeating monomer units, in embodiments from about 2 to about 20 repeating monomer units, in embodiments from about 3 to about 6 repeating monomer units.

The resin component of the compositions can be any film-forming polymer. Examples of suitable resins for use in the dispersion include thermoplastic and thermosetting resins such as polyesters including poly(ethylene terephthalate), polyurethanes including poly(tetramethylene hexamethylene diurethane), polystyrenes including poly(styrene-co-maleic anhydride), polybutadienes including polybutadiene-graft-poly(methyl acrylate-co-acrylontrile), polysulfones including poly(1,4-cyclohexane sulfone), polyarylethers including poly(phenylene oxide), polyarylsulfones including poly(phenylene sulfone), polyethersulfones including poly(phenylene oxide-co-phenylene sulfone), poly(cyclo olefins), polyethylenes including poly(ethylene-co-acrylic acid), polypropylenes, polymethylpentenes, polyphenylene sulfides, polyvinyl acetates, polyvinylbutyrals, polysiloxanes including poly (dimethylsiloxane), polyacrylates including poly(ethyl acrylate) and polymethacrylate, polyvinyl acetals, polyamides including poly(hexamethylene adipamide), polyimides including poly(pyromellitimide), amino resins including poly(vinyl amine), phenylene oxide resins including poly(2,6-dimethyl-1,4-phenylene oxide), terephthalic acid resins, phenoxy resins including poly(hydroxyethers), epoxy resins including poly([(o-cresyl glycidyl ether)-co-formaldehyde], phenolic resins including poly(4-tert-butylphenol-co-formaldehyde), polystyrene and acrylonitrile copolymers, polyacrylonitriles, polyvinylchlorides, polyvinyl alcohols, poly-N-vinylpyrrolidinones, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like, and combinations thereof. These polymers may be block, random, or alternating copolymers.

In some embodiments, the polymers utilized in generating the polymeric composition of the present disclosure include linear polycarbonates and polyarylates possessing a degree of polymerization of at least about 50, in some embodiments a degree of polymerization of at least about 100, which can be from about 100 to about 5,000, in embodiments from about 500 to about 2,000.

Suitable polycarbonate resins include ones having structural units derived from bifunctional phenols. Examples of such bifunctional phenols include bis-(4-hydroxyphenyl) methane, 1,1-bis-(4-hydroxyphenyl)ethane, 1,1-bis-(4-hydroxyphenyl)propane, 2,2-bis-(4-hydroxyphenyl)propane, 2,2-bis-(4-hydroxyphenyl)butane, 2,2-bis-(4-hydroxyphenyl)pentane, 2,2-bis-(4-hydroxyphenyl)-3-methylbutane, 2,2-bis-(4-hydroxyphenyl)hexane, 2,2-bis-(4-hydroxyphenyl)-4-methylpentane, 1,1-bis-(4-hydroxyphenyl)cyclopentane, 1,1-bis-(4-hydroxyphenyl)cyclohexane, bis-(4-hydroxy-3-methylphenyl)methane, bis-(4-hydroxy-3,5-dimethylphenyl)methane, 1,1-bis-(4-hydroxy-3-methylphenyl)ethane, 2,2-bis-(4-hydroxy-3-methylphenyl) propane, 2,2-bis-(4-hydroxy-3,5-dimethylphenyl)propane, 2,2-bis-(4-hydroxy-3-ethylphenyl)propane, 2,2-bis-(4-hydroxy-3-isopropylphenyl)propane, 2,2-bis-(4-hydroxy-3-sec-butylphenyl)propane, bis-(4-hydroxyphenyl)phenylmethane, 1,1-bis-(4-hydroxyphenyl)-1-phenylethane, 1,1-bis-(4-hydroxyphenyl)-1-phenylpropane, bis-(4-hydroxyphenyl)diphenylmethane, bis-(4-hydroxyphenyl) dibenzylmethane, 4,4'-dihydroxydiphenylether, 4,4'-dihydroxydiphenylsulfone, 4,4'-dihydroxydiphenylsulfide, phenolphthalein, 5,5'-(1-methylethylidene)bis[1,1'-(biphenyl)-2-ol], [1,1'-biphenyl]-4,4'-diol, [1,1'-biphenyl]-3,3'-diol, 4,4'-oxybisphenol, bis(4-hydroxyphenyl)methanone, 2,6-dihydroxynaphthalene, and 2,7-dihydroxynaphthalene. These structural units may be polymerized singly, or copolymerized in combinations of two or more thereof, for example from about 2 to about 10, in embodiments from about 3 to about 5. Similarly, the polycarbonate resins may be used singly, or used as a mixture of two or more thereof, for example from about 2 to about 10, in embodiments from about 3 to about 5.

In embodiments, polycarbonates which may be utilized include, but are not limited to, poly(4,4'-isopropylidene diphenyl carbonate) (also referred to as bisphenol A polycarbonate), poly(4,4'-diphenyl-1,1'-cyclohexane carbonate) (also referred to as bisphenol Z polycarbonate, polycarbonate Z, or PCZ), poly(4,4'-sulfonyl diphenyl carbonate) (also referred to as bisphenol S polycarbonate), poly(4,4'-ethylidene diphenyl carbonate) (also referred to as bisphenol E polycarbonate), poly(4,4'-methylidene diphenyl carbonate)

(also referred to as bisphenol F polycarbonate), poly(4,4'-(1,3-phenylenediisopropylidene)diphenyl carbonate) (also referred to as bisphenol M polycarbonate), poly(4,4'-(1,4-phenylenediisopropylidene)diphenyl carbonate) (also referred to as bisphenol P polycarbonate), and poly(4,4'-hexafluoroisppropylidene diphenyl carbonate). Where utilized, the polycarbonate may be present in an amount from about 5 to about 70 percentage by weight of the dispersion, in embodiments from about 15 to about 50 percentage by weight of the dispersion.

Examples of suitable polyarylates that may be utilized include, but are not limited to, polycondensates of a bifunctional phenol component and an aromatic dicarboxylic acid component. Examples of the aromatic dicarboxylic acid component that may be used include phthalic acid, isophthalic acid and terephthalic acid. Examples of the bifunctional phenol component which may be used include hydroquinone, resorcinol, 1,3-dihydroxynaphthalene, 1,4-dihydroxynaphthalene, 2,3-dihydroxynaphthalene, 2,6-dihydroxynaphthalene, 2,7-dihydroxynaphthalene, 1,8-dihydroxynaphthalene, 1,5-dihydroxynaphthalene, bis-(4-hydroxyphenyl)methane, bis-(2-hydroxyphenyl)methane, (2-hydroxyphenyl)(4-hydroxyphenyl)methane, 1,1-bis-(4-hydroxyphenyl)ethane, 1,1-bis-(4-hydroxyphenyl)propane, 2,2-bis-(4-hydroxyphenyl)propane, 2,2-bis-(4-hydroxyphenyl)butane, 2,2-bis-(4-hydroxyphenyl)pentane, 2,2-bis-(4-hydroxyphenyl)-3-methylbutane, 2,2-bis-(4-hydroxyphenyl)hexane, 2,2-bis-(4-hydroxyphenyl)-4-methylpentane, 1,1-bis-(4-hydroxyphenyl)cyclopentane, 1,1-bis-(4-hydroxyphenyl)cyclohexane, bis-(3-phenyl-4-hydroxyphenyl)methane, 1,1-bis-(3-phenyl-4-hydroxyphenyl)ethane, 1,1-bis-(3-phenyl-4-hydroxyphenyl)propane, 2,2-bis-(3-phenyl-4-hydroxyphenyl)propane, bis-(4-hydroxy-3-methylphenyl)methane, 1,1-bis-(4-hydroxy-3-methylphenyl)ethane, 2,2-bis-(4-hydroxy-3-methylphenyl)propane, 2,2-bis-(4-hydroxy-3-ethylphenyl)propane, 2,2-bis-(4-hydroxy-3-isopropylphenyl)propane, 2,2-bis-(4-hydroxy-3-sec-butylphenyl)propane, bis-(4-hydroxy-3,5-dimethylphenyl)methane, 1,1-bis-(4-hydroxy-3,5-dimethylphenyl)ethane, 2,2-bis-(4-hydroxy-3,5-dimethylphenyl)propane, bis-(4-hydroxy-3,6-dimethylphenyl)methane, 1,1-bis-(4-hydroxy-3,6-dimethylphenyl)ethane, bis-(4-hydroxyphenyl)phenylmethane, 1,1-bis-(4-hydroxyphenyl)-1-phenylethane, 1,1-bis-(4-hydroxyphenyl)-1-phenylpropane, bis-(4-hydroxyphenyl)diphenylmethane, bis-(4-hydroxyphenyl)dibenzylmethane, 4,4'-dihydroxydiphenylether, 4,4'-dihydroxydiphenylsulfone, 4,4'-dihydroxydiphenylsulfide, phenolphthalein, 4,4'-[1,4-phenylenebis(1-methylvinylidene)]bisphenol, and 4,4'-[1,4-phenylenebis(1-methylvinylidene)]bis[2-methylphenol].

In embodiments, bisphenol components which may be utilized in forming the polyarylate compound include bis-(4-hydroxyphenyl)methane, 1,1-bis-(4-hydroxyphenyl)ethane, 2,2-bis-(4-hydroxyphenyl)propane, 2,2-bis-(3-phenyl-4-hydroxyphenyl)propane, bis-(4-hydroxy-3-methylphenyl)methane, 1,1-bis-(4-hydroxyphenyl)cyclohexane, 1,1-bis-(4-hydroxy-3-methylphenyl)ethane, 2,2-bis-(4-hydroxy-3-methylphenyl)propane, bis-(4-hydroxy-3,5-dimethylphenyl)methane, 1,1-bis-(4-hydroxy-3,5-dimethylphenyl)ethane, 2,2-bis-(4-hydroxy-3,5-dimethylphenyl)propane, bis-(4-hydroxy-3,6-dimethylphenyl)methane, and 1,1-bis-(4-hydroxyphenyl)-1-phenylethane.

Where utilized, the polyarylate may be present in an amount from about 5 to about 70 percentage by weight of the dispersion, in embodiments from about 15 to about 50 percentage by weight of the dispersion.

The above resin is combined with a cyclic polymer possessing a degree of polymerization of 2 and above, for example from about 2 to about 50, in embodiments from about 3 to about 6, to produce the polymeric composition of the present disclosure.

Suitable cyclic oligomers which may be used in preparing polymeric compositions of the present disclosure include, but are not limited to, cyclic polyesters, cyclic copolyesters, cyclic polycarbonates and cyclic copolycarbonates. Cyclic polyester oligomers which may be used include cyclic poly(1,4-butylene terephthalate) (CBT), cyclic poly(1,3-propylene terephthalate) (CPT), cyclic poly(1,4-cyclohexylenedimethylene terephthalate) (CCT), cyclic poly(ethylene terephthalate) (CET), cyclic poly(1,2-ethylene 2,6-naphthalenedicarboxylate) (CEN) oligomers, and cyclic copolyester oligomers comprising two or more of the above monomer repeat units. In some embodiments, cyclic poly(butylene terephthalate) (CBT) and cyclic ethylene terephthalate (CET), each of which possesses about 2 to about 6 units of the monomer, in embodiments from about 3 to about 5 units of the monomer, may be utilized.

Cyclic polycarbonate oligomers which may be utilized include cyclic poly(bisphenol A carbonate), cyclic poly(bisphenol C carbonate), cyclic poly(bisphenol E carbonate), cyclic poly(bisphenol F carbonate), cyclic poly(bisphenol M carbonate), cyclic poly(bisphenol P carbonate), cyclic poly(bisphenol S carbonate), cyclic poly(bisphenol Z carbonate) oligomers, and cyclic copolycarbonate oligomers comprising two or more of the above monomer repeat units, in embodiments from about 2 to about 6 units of the monomer, in embodiments from about 3 to about 5 units of the monomer.

In embodiments, cyclic poly(bisphenol A carbonate) and cyclic poly(bisphenol Z carbonate), may be utilized. The chemical structures of CBT, CET and cyclic poly(bisphenol A carbonate) are shown below, where n can range from about 2 to about 6, in embodiments from about 3 to about 5.

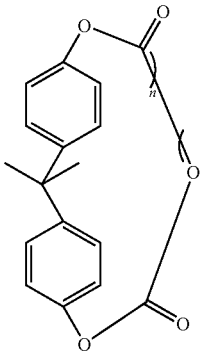

cyclic poly(bisphenol A carbonate)

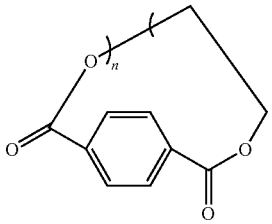

CET

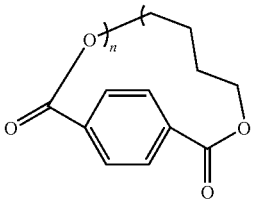

CBT

Methods for producing such cyclic oligomers are known and include those, for example, disclosed in U.S. Pat. Nos.

6,855,798, 6,713,601 and 6,420,047, and WO 02/098946, the entire disclosures of each of which are incorporated by reference herein.

In embodiments, the polymeric composition of the present disclosure, that is the resin and cyclic polymer, may be referred to as a polymeric blend. In embodiments, a "polymer blend" or "polymeric blend" refers for example, to a homogeneous mixture of a resin and a cyclic polymer that sometimes features grafting between the different molecules when they cleave during melt mixing, but otherwise exists as a two-phase system. Any method known to those skilled in the art may be utilized to form a polymeric blend of the present disclosure. The resin may be present in such a blend in an amount from about 90 to about 10 percentage by weight of the polymer blend, in embodiments from about 70 to about 30 percentage by weight of the polymer blend, in embodiments from about 60 to about 40 percentage by weight of the polymer blend. Similarly, the cyclic polymer may be present in such a blend in an amount from about 10 to about 90 percentage by weight of the polymer blend, in embodiments from about 30 to about 70 percentage by weight of the polymer blend, in embodiments from about 40 to about 60 percentage by weight of the polymer blend.

In embodiments the polymeric composition of the present disclosure may be utilized to form a charge transport layer on the surface of a photoreceptor. In embodiments, a polymeric blend of the present disclosure may also contain a charge transport molecule, also referred to herein as a hole transport molecule (HTM). Any suitable charge transporting or electrically active molecules known to those skilled in the art may be employed as HTMs in forming a charge transport layer on a photoreceptor. Suitable charge transport compounds include, for example, pyrazolines as described in U.S. Pat. Nos. 4,315,982, 4,278,746, 3,837,851, and 6,214,514, the entire disclosures of each of which are incorporated by reference herein. Suitable pyrazoline charge transport compounds include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)pyrazoline, and the like.

Charge transport compounds also include aryl amines and diamines as described in U.S. Pat. Nos. 4,306,008, 4,304,829, 4,233,384, 4,115,116, 4,299,897, 4,265,990, 4,081,274 and 6,214,514, the entire disclosures of each of which are incorporated by reference herein. In embodiments, an aryl amine charge hole transporting component may be represented by:

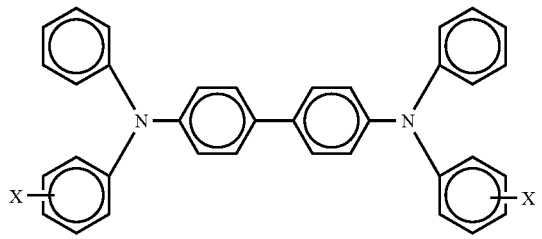

wherein X is selected from the group consisting of alkyl, halogen, alkoxy or mixtures thereof. In embodiments, the halogen is a chloride. Alkyl groups may contain, for example, from about 1 to about 10 carbon atoms and, in embodiments, from about 1 to about 5 carbon atoms. Examples of suitable aryl amines include, but are not limited to, N,N'-diphenyl-N,N'-bis(alkylphenyl)-1,1-biphenyl-4,4'-diamine, wherein the alkyl may be methyl, ethyl, propyl, butyl, hexyl, and the like; and N,N'-diphenyl-N,N'-bis(halophenyl)-1,1'-biphenyl-4,4'-diamine, wherein the halo may be a chloro, bromo, fluoro, and the like substituent.

Other suitable aryl amine transport compounds include N,N'-diphenyl-N,N'-bis(alkylphenyl)-[1,1'-biphenyl]-4,4'-diamine wherein the alkyl is linear such as for example, methyl, ethyl, propyl, n-butyl and the like, N,N'-diphenyl-N,N'-bis(3"-methylphenyl)-[1,1'-biphenyl]-4,4'-diamine, N,N'-diphenyl-N,N'-bis(4-methylphenyl)-[1,1'-biphenyl]-4,4'-diamine, N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

The weight ratio of the polymeric composition to charge transport molecules in the resulting charge transport layer can range, for example, from about 80/20 to about 30/70. In embodiments the weight ratio of the polymeric composition to charge transport molecules can range from about 70/30 to about 40/60, in embodiments from about 60/40 to about 50/50.

Any suitable and conventional technique may be utilized to mix the polymeric composition in combination with the hole transport material and apply same as a charge transport layer to the surface of a photoreceptor. In embodiments it may be advantageous to add a polymeric blend of the present disclosure and hole transport material to a solvent to aid in formation of a charge transport layer and its application to the surface of a photoreceptor. Examples of solvents which may be utilized include aromatic hydrocarbons, aliphatic hydrocarbons, halogenated hydrocarbons, ethers, amides and the like, or mixtures thereof. In some embodiments, a solvent such as cyclohexanone, cyclohexane, chlorobenzene, carbon tetrachloride, chloroform, methylene chloride, trichloroethylene, tetrahydrofuran, dioxane, dimethyl formamide, dimethyl acetamide and the like, may be utilized.

Typical application techniques for applying the polymeric composition of the present disclosure to the surface of a photoreceptor, optionally in combination with a hole transport molecule, include spraying, dip coating, roll coating, wire wound rod coating, and the like. Drying of the deposited coating may be effected by any suitable conventional technique such as oven drying, infrared radiation drying, air drying and the like.

The polymeric composition of the present disclosure can be used as a surface layer in conjunction with any configuration for photoreceptors within the purview of those skilled in the art. Such configurations include, for example, single layer photoreceptors and multi-layer photoreceptors. Suitable configurations of multi-layer photoreceptors include, but are not limited to, the photoreceptors described in U.S. Pat. Nos. 6,800,411, 6,824,940, 6,818,366, 6,790,573, and U.S. Patent Application Publication No. 20040115546, the entire contents of each of which are incorporated by reference herein. Multi-layer photoreceptors typically possess a charge generating layer (CGL), also referred to herein as a photogenerating layer, and a charge transport layer (CTL). Other layers, including a substrate, an electrically conductive layer, a charge blocking or hole blocking layer, an adhesive layer, and/or an overcoat layer, may also be present in the photoreceptor.

In one embodiment, a polymeric blend of the present disclosure may be utilized to form a charge transport layer as the surface layer of a photoreceptor. In such a case, the charge transport layer not only serves to transport holes or electrons, but also protects the photoconductive device from abrasion or chemical attack. Charge transport layers are typically transparent in a wavelength region in which the electrophotographic imaging member is to be used when exposure is effected therethrough to ensure that most of the incident radiation is utilized by the underlying charge generating layer. The charge transport layer should exhibit negligible charge generation and discharge, if any, when exposed to a wavelength of light useful in xerography, for example, 4000 to 9000 Angstroms. The charge transport layer should trap minimal charges; either holes for a negatively charged system, or electrons for a positively charged system.

Generally, the thickness of the charge transport layer can range from about 2 microns and about 50 microns, in embodiments from about 15 microns to about 30 microns, but thicknesses outside this range can also be used. The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generation layer, where present, is typically from about 2:1 to 200:1 and in some instances as great as 400:1.

In other embodiments the polymeric composition of the present disclosure may be utilized to form an overcoat layer as a surface layer of a photoreceptor. In such a case, the resin and cyclic polymer may be combined to form a polymeric blend as described above, which may then be applied to the surface of the photoreceptor utilizing any method known to those skilled in the art. In some embodiments the polymeric composition of the present disclosure may be utilized as an overcoat layer without the addition of hole transport molecules. However, in other embodiments, hole transport molecules as described above may also be included in the polymeric composition and applied as an overcoat layer.

Where the polymeric composition of the present disclosure is utilized as an overcoat layer of a photoreceptor, the thickness of the overcoat layer may range, for example, from about 0.1 microns to about 25 microns, typically from about 1 micron to about 10 microns, more typically from about 1 micron to about 5 microns.

As noted above, a photoreceptor having the polymeric composition of the present disclosure as a surface layer may have additional layers, including a substrate, a charge generating layer, and the like.

Suitable substrates which may be utilized in forming a photoreceptor are known to those skilled in the art. The photoreceptor substrate may be opaque or substantially transparent, and may include any suitable organic or inorganic material having the requisite mechanical properties.

The substrate may be flexible, seamless, or rigid and may be of a number of different configurations such as, for example, a plate, a cylindrical drum, a scroll, an endless flexible belt, and the like. In some embodiments, it may be desirable to coat on the back of the substrate, particularly when the substrate is a flexible organic polymeric material, an anticurl layer such as, for example, polycarbonate materials commercially available as MAKROLON® from Bayer Material Science.

The thickness of the substrate layer may depend on numerous factors, including mechanical performance and economic considerations. For rigid substrates, the thickness of the substrate can range from about 3 millimeters to about 10 millimeters. For flexible substrates, the substrate thickness can range from about 65 microns to about 150 microns, in some embodiments from about 75 microns to about 100 microns, for optimum flexibility and minimum stretch when cycled around small diameter rollers of, for example, 19-millimeter diameter. The entire substrate can be made of an electrically conductive material, or the electrically conductive material can be a coating on a polymeric substrate.

Substrate layers selected for the imaging members of the present disclosure, and which substrates can be opaque or substantially transparent, may include a layer of insulating material including inorganic or organic polymeric materials such as MYLAR® (a commercially available polymer from DuPont), MYLAR® containing titanium, a layer of an organic or inorganic material having a semiconductive surface layer, such as indium tin oxide or aluminum arranged thereon, or a conductive material inclusive of aluminum, chromium, nickel, brass or the like.

Any suitable electrically conductive material can be employed with the substrate. Suitable electrically conductive materials include copper, brass, nickel, zinc, chromium, stainless steel, conductive plastics and rubbers, aluminum, semi-transparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein, or through conditioning in a humid atmosphere to ensure the presence of sufficient water content to render the material conductive, indium, tin, metal oxides, including tin oxide and indium tin oxide, and the like.

In some cases, an anti-curl back coating may be applied to the side opposite the photoreceptor to provide flatness and/or abrasion resistance where a web configuration photoreceptor is fabricated. Anti-curl back coating layers are well known in the art and may include thermoplastic organic polymers or inorganic polymers that are electrically insulating or slightly semi-conductive. The thickness of anti-curl backing layers should be sufficient to substantially balance the total forces of the layer or layers on the opposite side of the supporting substrate layer. An example of an anti-curl backing layer is described in U.S. Pat. No. 4,654,284, the entire disclosure of which is incorporated herein by reference. A thickness from about 70 microns to about 160 microns is a satisfactory range for flexible photoreceptors.

After formation of an electrically conductive surface, a hole blocking layer may optionally be applied to the substrate layer. Generally, hole blocking layers (also referred to as electron blocking layers or charge blocking layers) allow holes from the imaging surface of the photoreceptor to migrate toward the conductive layer. Any suitable blocking layer capable of forming an electronic barrier to holes between the adjacent photoconductive layer and the underlying conductive layer may be utilized. Blocking layers are well known and disclosed, for example, in U.S. Pat. Nos. 4,286, 033, 4,291,110 and 4,338,387, the entire disclosures of each of which are incorporated herein by reference. Similarly, illustrated in U.S. Pat. Nos. 6,255,027, 6,177,219, and 6,156,468, the entire disclosures of each of which are incorporated herein by reference, are, for example, photoreceptors containing a hole blocking layer of a plurality of light scattering particles dispersed in a binder. For instance, Example 1 of U.S. Pat. No. 6,156,468 discloses a hole blocking layer of titanium dioxide dispersed in a linear phenolic binder.

Typical hole blocking layers utilized for the negatively charged photoconductors may include, for example, polyamides including LUCKAMIDE® (a nylon type material derived from methoxymethyl-substituted polyamide commercially available from Dai Nippon Ink), hydroxy alkyl methacrylates, nylons, gelatin, hydroxyl alkyl cellulose, organopolyphosphazines, organosilanes, organotitanates, organozirconates, metal oxides of titanium chromium, zinc, tin, silicon, and the like. In some embodiments the hole blocking layer may include nitrogen containing siloxanes. Typical nitrogen containing siloxanes may be prepared from coating solutions containing a hydrolyzed silane. Typical hydrolyzable silanes include 3-aminopropyl triethoxy silane, N,N'-dimethyl 3-amino)propyl triethoxysilane, N,N-dimethylamino phenyl triethoxy silane, N-phenyl aminopropyl trimethoxy silane, trimethoxy silylpropyldiethylene triamine and mixtures thereof.

In some embodiments, the hole blocking components may be combined with phenolic compounds, a phenolic resin, or a mixture of 2 phenolic resins. Suitable phenolic compounds which may be utilized may contain at least two phenol groups, such as bisphenol A (4,4'-isopropylidenediphenol), bisphenol E (4,4'-ethylidenebisphenol), bisphenol F (bis(4-hydroxyphenyl)methane), bisphenol M (4,4'-(1,3-phenylenediisopropylidene)bisphenol), bisphenol P (4,4'-(1,4-phenylene diisopropylidene)bisphenol), bisphenol S (4,4'-sulfonyldiphenol), and bisphenol Z (4,4'-cyclohexylidenebisphenol), hexafluorobisphenol A (4,4'-(hexafluoro isopropylidene)diphenol), resorcinol, hydroxyquinone, catechin, and the like.

The hole blocking layer may be applied as a coating by any suitable conventional technique such as spraying, die coating, dip coating, draw bar coating, gravure coating, silk screening, air knife coating, reverse roll coating, vacuum deposition, chemical treatment and the like. For convenience in obtaining thin layers, the blocking layers may be applied in the form of a dilute solution, with the solvent being removed after deposition of the coating by conventional techniques such as by vacuum, heating and the like. Drying of the deposited coating may be effected by any suitable conventional technique such as oven drying, infrared radiation drying, air drying and the like.

The blocking layer may include an oxidized surface which forms on the outer surface of most metal ground plane surfaces when exposed to air. The blocking layer should be continuous and have a thickness of from about 0.01 microns to about 30 microns, typically from about 0.1 microns to about 8 microns.

An optional adhesive layer may be applied to the hole blocking layer. Any suitable adhesive layer known in the art may be utilized including, but not limited to, polyesters, polyamides, poly(vinyl butyral), poly(vinyl alcohol), polyarylates, polyurethanes and polyacrylonitrile. Where present, the adhesive layer may be, for example, of a thickness of from about 0.001 microns to about 1 micron. Optionally, the adhesive layer may contain effective suitable amounts, for example from about 1 weight percent to about 10 weight percent, of conductive and nonconductive particles, such as zinc oxide, titanium dioxide, silicon nitride, carbon black, and the like, to provide further desirable electrical and optical properties to the photoreceptor of the present disclosure. Satisfactory results may be achieved with an adhesive layer thickness from about 0.05 microns to about 0.3 microns. Conventional techniques for applying an adhesive layer coating mixture to the hole blocking layer include spraying, dip coating, roll coating, wire wound rod coating, gravure coating, die coating and the like. Drying of the deposited coating may be effected by any suitable conventional technique such as oven drying, infrared radiation drying, air drying and the like.

In some embodiments, a charge generating layer may be applied to the substrate, optional hole blocking layer, or optional adhesive layer. The charge generating layer can contain known photogenerating pigments, such as metal phthalocyanines, metal free phthalocyanines, alkylhydroxyl gallium phthalocyanine, hydroxygallium phthalocyanines, chlorogallium phthalocyanines, perylenes, especially bis (benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium.

The photogenerating pigment can be dispersed in a resin binder similar to the resin binders selected for the charge transport layer, or alternatively no resin binder can be present. Where present, any suitable film forming binder known to those skilled in the art may be utilized to form the charge generating layer. Examples of suitable binders for use in the charge generator layer include thermoplastic and thermosetting resins such as polycarbonates, polyesters, including polyethylene terephthalate, polyurethanes, polystyrenes, polybutadienes, polysulfones, polyarylethers, polyarylsulfones, polyethersulfones, polyethylenes, polypropylenes, polymethylpentenes, polyphenylene sulfides, polyvinyl acetates, polyvinylbutyrals, polysiloxanes, polyacrylonitriles, polyacrylates and methacrylates, polyvinyl acetals, polyamides, polyimides, amino resins, phenylene oxide resins, terephthalic acid resins, phenolic resins, epoxy resins, phenolic resins, polystyrene and acrylonitrile copolymers, polyvinylchlorides, polyvinyl alcohols, poly-N-vinylpyrrolidinones, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers may be block, random or alternating copolymers.

The charge generating layer containing photoconductive components, like photogenerating pigments and the resinous binder material generally ranges in thickness from about 0.05 microns to about 100 microns, in embodiments from about 0.1 microns to about 5 microns, in embodiments from about 0.3 microns to about 3 microns, although the thickness may be outside these ranges.

When the photogenerating material is present in a binder material, the photogenerating composition or pigment may be present in a polymer binder composition in any suitable or desired amounts. For example, from about 10 percent by volume to about 60 percent by volume of the photogenerating pigment may be dispersed in from about 40 percent by volume to about 90 percent by volume of the film forming polymer binder composition and, in some embodiments, from about 20 percent by volume to about 30 percent by volume of the photogenerating pigment may be dispersed in about 70 percent by volume to about 80 percent by volume of the film forming polymer binder composition. Typically, the photoconductive material may be present in the charge generating layer in an amount of from about 5 percent to about 80 percent by weight of the charge generating layer and, in some embodiments, from about 25 percent to about 75 percent by weight of the charge generating layer. Thus, the polymeric binder may be present in an amount of from about 20 percent to about 95 percent by weight of the charge generating layer and, in some embodiments, from about 25 percent to about 75 percent by weight of the charge generating layer, although the relative amounts can be outside these ranges.

As would be readily appreciated by one skilled in the art, the charge generating layer thickness is related to the relative amounts of photogenerating compound and binder; higher binder content compositions generally require thicker layers for photogeneration. Generally, it may be desirable to provide this layer in a thickness sufficient to absorb about 90 percent or more of the incident radiation which is directed upon it in the imagewise or printing exposure step. The maximum thickness of this layer depends upon factors such as mechanical considerations, the specific photogenerating compound selected, the thicknesses of the other layers, and whether a flexible photoconductive imaging member is desired. In some embodiments, the charge generation layer can be of a thickness of, for example, from about 0.05 microns to about 10 microns, typically from about 0.25 micron to about 2 microns when, for example, the photogenerator compositions are present in an amount of from about 30 percent to about 75 percent by volume.

Any suitable technique may be utilized to mix and thereafter apply the charge generating layer coating mixture to an underlying layer of a photoreceptor, such as a substrate. Typical application techniques include spraying, dip coating, roll coating, wire wound rod coating, and the like. Drying of the deposited coating may be effected by any suitable technique, such as, oven drying, infrared radiation drying, air drying, and the like.

In some embodiments a solvent may be utilized to apply the charge generation layer to the photoreceptor. Typically, any coating solvent utilized should not substantially disturb or adversely affect the other previously coated layers of the device. Examples of solvents that can be selected for use as coating solvents for the charge generating layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

Where present in a photoreceptor, the charge generating layer, charge transport layer, and other layers may be applied in any suitable order to produce either positive or negative charging photoreceptors. For example, the charge generating layer may be applied prior to the charge transport layer, as illustrated in U.S. Pat. No. 4,265,990, or the charge transport layer may be applied prior to the charge generating layer, as illustrated in U.S. Pat. No. 4,346,158, the entire disclosures of each of which are incorporated by reference herein. In other embodiments, the charge transport layer may optionally be overcoated with an overcoat and/or protective layer.

In some embodiments the charge generating layer may include about 60 weight percent hydroxygallium phthalocyanine Type V in combination with about 40 weight percent of a resin binder like polyvinyl chloride vinyl acetate copolymer such as VMCH (commercially available from Dow Chemical).

Processes of imaging, especially xerographic imaging and printing, including digital, are also encompassed by the present disclosure. More specifically, the layered photoconductive imaging members of the present disclosure can be selected for a number of different known imaging and printing processes including, for example, electrophotographic imaging processes, especially xerographic imaging and printing processes wherein charged latent images are rendered visible with toner compositions of an appropriate charge polarity. Methods of imaging and printing with the photoresponsive devices illustrated herein generally involve the formation of an electrostatic latent image on the imaging member, followed by developing the image with a toner composition. The toner composition can include, for example, thermoplastic resin, colorant, such as pigment, charge additive, and surface additives. (See, for example, U.S. Pat. Nos. 4,560,635; 4,298,697 and 4,338,390, the disclosures of each of which are incorporated herein by reference.) The image is then transferred to a suitable substrate and permanently affixed thereto. In those environments wherein the device is to be used in a printing mode, the imaging method involves the same aforementioned sequence with the exception that the exposure step can be accomplished with a laser device or image bar.

In some embodiments the imaging members may be sensitive in the wavelength region of, for example, from about 500 to about 900 nanometers, typically from about 650 to about 850 nanometers; thus diode lasers can be selected as the light source. Moreover, the imaging members of this disclosure may be useful in color xerographic applications, particularly high-speed color copying and printing processes.

A polymeric composition of the present disclosure, when applied as a surface layer to a photoreceptor, provides excellent photoinduced discharge characteristics, cyclic and environmental stability, and acceptable charge deficient spot levels arising from dark injection of charge carriers. Moreover, polymeric blends of the present disclosure provide photoresponsive imaging members with mechanically robust and wear resistant surfaces.

The polymeric composition of the present disclosure is a completely miscible transparent film due to the similarity of the chemical structures between the resin and the cyclic oligomer. Some catalysts such as titanium compounds may be added to increase the degree of polymerization. In addition, trans-esterification reactions between the cyclic polymer and the resin are also possible. However, notwithstanding the foregoing, it should be understood that the resins and cyclic polymers of the present disclosure utilized to form the surface layer do not, in fact, undergo any cross-linking reaction.

The surface layer having a polymeric composition of the present disclosure exhibits enhanced charge transport. With a lower HTM loading, it possesses a lower Vr, indicating an enhanced charge transport, partially due to the incorporation of a relatively non-polar polymeric moiety into the polymeric matrix, for example, the butylene moieties of CBT. Thus, surface layers of the present disclosure possessing HTM may have a Vr of from about 10 V to about 80 V lower than the Vr of conventional charge transport layers, in embodiments from about 30 V to about 50 V lower than the Vr of conventional charge transport layers.

The surface layer having a polymeric composition of the present disclosure exhibits improved wear resistance when compared with the conventional surface layer containing a single polymer. Without wishing to be bound by any theory, this improved wear resistance may be due to the oligomer filling in free volume of the resin to make the polymeric blend system more compact. Wear resistance tests may be performed using commercially available equipment, including a FX469 (Fuji Xerox) wear fixture. The total thickness of the surface layer of a photoreceptor may be determined before a wear test is initiated. Then the photoreceptor may be placed into the wear fixture for 50 kcycles. The total thickness may be measured again, and the difference in thickness may be used to calculate wear rate (nm/kcycle) of the device. Surface layers of the present disclosure may have a wear rate of from about 40 nm/kcycle to about 80 nm/kcycle lower than the wear rate of known surface layers, or from about 50 nm/kcycle to about 70 nm/kcycle lower than the wear rate of known surface layers.

The following Examples are being submitted to illustrate embodiments of the present disclosure. These Examples are intended to be illustrative only and are not intended to limit the scope of the present disclosure. Also, parts and percentages are by weight unless otherwise indicated. A comparative example and data are also provided.

EXAMPLE 1

Two multilayered photoreceptors of the rigid drum design were fabricated by conventional coating technology with an aluminum drum of 34 millimeters in diameter as the substrate. These two drum photoreceptors contained the same undercoat layer (UCL) and charge generating layer (CGL), but the two drum photoreceptors had a different charge transport layer (CTL). The two photoreceptor devices were prepared with the following structures: a 3-component undercoat layer, a hydroxyl gallium phthalocyanine (V) charge generating layer and a 24 μm charge transport layer.

More specifically, the 3-component undercoat layer was prepared as follows: Zirconium acetylacetonate tributoxide (35.5 parts), γ-aminopropyltriethoxysilane (4.8 parts) and poly(vinyl butyral) BM-S (2.5 parts) were dissolved in n-butanol (52.2 parts). The coating solution was coated via a ring coater, and the layer was pre-heated at 59° C. for 13 minutes, humidified at 58° C. (dew point=54° C.) for 17 minutes, and then dried at 135° C. for 8 minutes. The thickness of the undercoat layer was approximately 1.3 μm.

A 0.5 micron thick photogenerating layer was subsequently coated on top of the above generated undercoat layer from a dispersion of Type V hydroxyl gallium phthalocyanine (3.0 grams) and a vinyl chloride/vinyl acetate copolymer, VMCH ($M_n$=27,000, about 86 weight percent of vinyl chloride, about 13 weight percent of vinyl acetate and about 1 weight percent of maleic acid available from Dow Chemical (2 grams), in 95 grams of n-butyl acetate.

As noted above, the only difference between the two drum photoreceptors was that Device I contained a charge transport layer (CTL) made of a film forming polymer binder and a charge transport compound; Device II contained the same layers as Device I except that cyclic butylene terephthalate (CBT XB0-C available from Cyclics Corporation, Schenectady, N.Y.) was incorporated into the charge transport layer.

Preparation of CTL for Device I. A CTL solution was prepared by dissolving 5 grams of N,N'-diphenyl-N,N-bis(3-methylphenyl)-1,1'-biphenyl-4,4'-diamine (mTBD) and 7.5 grams of a film forming polymer binder, PCZ-400 (poly(4,4'-dihydroxy-diphenyl-1,1-cyclohexane), $M_w$=40,000 available from Mitsubishi Gas Chemical Company, Ltd.), in a solvent mixture of 20 grams of tetrahydrofuran (THF) and 6.7 grams of toluene. The weight ratio of PCZ-400/mTBD was 60/40 in the THF/toluene and the PCZ-400/mTBD charge transport layer was homogeneous in the THF/toluene solution. The CTL solution was applied to the charge generation layer of Device I by a Tsukiage coater. The charge transport layer was dried at 120° C. for 45 minutes.

Preparation of CTL for Device II. A polycarbonate Z (PCZ)/cyclic butylene terephthalate (CBT) blend was prepared and utilized as a charge transport layer. A homogeneous charge transporting layer (CTL) was prepared by combining 13.6 grams of a polycarbonate, PCZ-400 (poly(4,4'-dihydroxy-diphenyl-1,1-cyclohexane), Mw equal to 40,000 available from Mitsubishi Gas Chemical Company, Ltd.), with 9.1 grams of N,N'-diphenyl-N,N-bis(3-methyl phenyl)-1,1'-biphenyl-4,4'-diamine (mTBD) and 2.3 grams of cyclic butylene terephthalate (CBT XB0-C available from Cyclics Corporation, Schenectady, N.Y.) in a mixture of 52.5 grams of tetrahydrofuran (THF) and 22.5 grams of toluene. The weight ratio of PCZ-400/mTBD/CBT XB0-C was 54.5/36.4/9.1 in the THF/toluene and the PCZ-400/mTBD/CBT XB0-C charge transport layer was homogeneous in the THF/toluene solution. The CTL solution was applied to the charge generation layer of Device II by a Tsukiage coater. The photoreceptor was then dried at 170° C. for 40 minutes to allow the in-situ polymerization of the cyclic oligomer (CBT) into its linear polymeric form.

The above two photoreceptor devices were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 and 700 volts with the exposure light intensity incrementally increased by means of regulating a series of neutral density filters; the exposure light source was a 780-nanometer light emitting diode. The aluminum drum was rotated at a speed of 55 revolutions per minute to produce a surface speed of 277 millimeters per second or a cycle time of 1.09 seconds. The xerographic simulation was completed in an environmentally controlled light tight chamber at ambient conditions (40 percent relative humidity and 22° C.).

Two photoinduced discharge characteristic (PIDC) curves were obtained from the two different pre-exposed surface potentials, and the data was interpolated into PIDC curves at an initial surface potential of 700 volts. The PIDC characteristics obtained are graphically depicted in the FIGURE.

As can be seen from the FIGURE, the surface layer of the present disclosure had a lower HTM loading (real HTM loading was ~36 wt %) exhibiting a 20V lower Vr when compared with the control, which clearly indicated enhancement of charge transport with incorporation of less polar CBT moieties into the polymeric matrix forming the charge transport layer. The charge transport layer having the 54.5/36.4/9.1 weight ratio of PCZ-400/mTBD/CBT XB0-C (Device II) possessed excellent photoinduced discharge characteristics (PIDC) with a lower Vr (the residual voltage on the photoreceptor) when compared with the conventional transport layer, that is, the 60/40 weight ratio of PCZ-400/mTBD (Device I).

Wear resistance tests of the above two devices were performed using a FX469 (Fuji Xerox) wear fixture. The total thickness of each device was measured via PERMASCOPE®

(Kett Electric Laboratory, Tokyo, Japan) before each wear test was initiated. Then the devices were separately placed into the wear fixture for 50 kcycles. The total thickness was measured again, and the difference in thickness was used to calculate wear rate (nm/kcycle) of the device. The smaller the wear rate, the more wear resistant was the imaging member.

The wear rate of the PCZ-400/mTBD/CBT XB0-C polymeric blend was tested with a BCR (biased charging roll) wear fixture. The polymeric blend layer showed about 40% improved wear resistance compared to the PCZ-400/mTBD control (wear rate under BCR improved from 100 nm/kcycles for Device I to 60 nm/kcycles for Device II).

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A photoconductive imaging member comprising a surface layer comprising a blend comprising at least one resin selected from the group consisting of poly(ethylene terephthalate), poly(tetramethylene hexamethylene diurethane), poly(styrene-co-maleic anhydride), polybutadiene-graft-poly(methyl acrylate-co-acrylontrile), poly(1,4-cyclohexane sulfone), poly(phenylene oxide), poly(phenylene sulfone), poly(phenylene oxide-co-phenylene sulfone), poly(ethylene-co-acrylic acid), poly(dimethylsiloxane), poly(ethyl acrylate), polymethacrylate, poly(hexamethylene adipamide), poly(pyromellitimide), poly(vinyl amine), poly(2,6-dimethyl-1,4-phenylene oxide), poly(hydroxyethers), poly([(o-cresyl glycidyl ether)-co-formaldehyde], poly(4-tert-butylphenol-co-formaldehyde), poly(4,4'-isopropylidene diphenyl carbonate), poly(4,4'-diphenyl-1,1'-cyclohexane carbonate), poly(4,4'-sulfonyl diphenyl carbonate), poly(4,4'-ethylidene diphenyl carbonate), poly(4,4'-methylidene diphenyl carbonate), poly(4,4'-(1,3-phenylenediisopropylidene)diphenyl carbonate), poly(4,4'-(1,4-phenylenediisopropylidene)diphenyl carbonate), poly(4,4'-hexafluoroisopropylidene)diphenyl carbonate, and combinations thereof present in an amount of from about 90 percent by weight to about 10 percent by weight of the blend, and at least one cyclic polymer selected from the group consisting of cyclic poly(1,4-butylene terephthalate), cyclic poly(1,3-propylene terephthalate), cyclic poly(1,4-cyclohexylenedimethylene terephthalate), cyclic polyethylene terephthalate, cyclic poly (1,2-ethylene 2,6-naphthalenedicarboxylate, cyclic poly(butylene terephthalate), and combinations thereof, present in an amount of from about 10 percent by weight to about 90 percent by weight of the blend, the surface layer being selected from the group consisting of overcoat layers and charge transport layers.

2. The photoconductive imaging member of claim 1, wherein the surface layer comprises from about 2 to about 10 resins and about 2 to about 10 cyclic polymers.

3. The photoconductive imaging member of claim 1, wherein the resin possesses a degree of polymerization of from about 50 to about 5,000.

4. The photoconductive imaging member of claim 1, further comprising a cyclic polymer is selected from the group consisting of cyclic poly(bisphenol A carbonate), cyclic poly (bisphenol C carbonate), cyclic poly(bisphenol E carbonate), cyclic poly(bisphenol F carbonate), cyclic poly(bisphenol M carbonate), cyclic poly(bisphenol P carbonate), cyclic poly (bisphenol S carbonate), and cyclic poly(bisphenol Z carbonate).

5. The photoconductive imaging member of claim 1, wherein the surface layer is an overcoat layer having a thickness of from about 0.1 microns to about 25 microns and further comprising an optional hole transport molecule.

6. The photoconductive imaging member of claim 1, wherein the surface layer is an overcoat layer having a thickness of from about 1 micron to about 10 microns.

7. The photo conductive imaging member of claim 1, wherein the surface layer is a charge transport layer further comprising at least one hole transport molecule.

8. The photoconductive imaging member of claim 7, wherein the hole transport molecule comprises an aryl amine of the formula

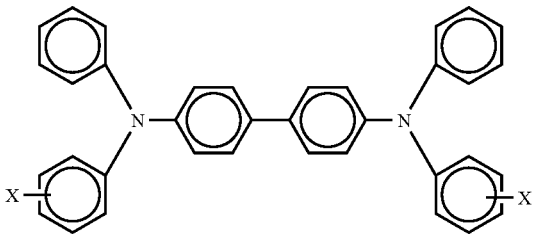

wherein X is selected from the group consisting of alkyl, halogen and mixtures thereof.

9. The photoconductive imaging member of claim 7, wherein the charge transport layer has a thickness of from about 2 microns to about 50 microns and the hole transport molecule is selected from the group consisting of N,N'-diphenyl-N,N'-bis(methylphenyl)-1,1-biphenyl-4,4'-diamine, N,N'-diphenyl-N,N'-bis(ethylphenyl)-1,1-biphenyl-4,4'-diamine, N,N'-diphenyl-N,N'-bis(propylphenyl)-1,1-biphenyl-4,4'-diamine, N,N'-diphenyl-N,N'-bis(butylphenyl)-1,1-biphenyl-4,4'-diamine, N,N'-diphenyl-N,N'-bis(hexylphenyl)-1,1-biphenyl-4,4'-diamine, N,N'-diphenyl-N,N'-bis (chlorophenyl)-1,1'-biphenyl-4,4'-diamine, N,N'-diphenyl-N,N-bis(3-methyl phenyl)-1,1'-biphenyl-4,4'-diamine, tritolylamine, N,N'-bis(3,4 dimethylphenyl)-N"(1-biphenyl) amine, 2-bis((4'-methylphenyl)amino-p-phenyl) 1,1-diphenyl ethylene, 1-bisphenyl-diphenylamino-1-propene, triphenylmethane, bis(4-diethylamine-2-methylphenyl) phenylmethane, 4'-4"-bis(diethylamino)-2',2"-dimethyltriphenylmethane, N,N'-bis(methylphenyl)-[1,1'-biphenyl]-4,4'-diamine, N,N'-bis(ethylphenyl)-[1,1'-biphenyl]-4,4'-diamine, N,N'-bis(propylphenyl)-[1,1'-biphenyl]-4,4'-diamine, N,N'-bis(n-butylphenyl)-[1,1'-biphenyl]-4,4'-diamine, and N,N'-diphenyl-N,N'-bis (3"-methylphenyl)-(1,1'-biphenyl)-4,4'-diamine.

10. The photoconductive imaging member of claim 1, further comprising a photogenerating layer of about 15 weight percent to about 95 weight percent of a resin, about 5 weight percent to about 85 weight percent of a photogenerating component selected from the group consisting of metal phthalocyanines, metal free phthalocyanines, alkylhydroxyl gallium phthalocyanines, hydroxygallium phthalocyanines, chlorogallium phthalocyanines, and perylenes, an optional substrate, an optional hole blocking layer, and an optional adhesive layer.

* * * * *

UNITED STATES PATENT AND TRADEMARK OFFICE

CERTIFICATE OF CORRECTION

PATENT NO. : 7,642,028 B2
APPLICATION NO. : 11/227564
DATED : January 5, 2010
INVENTOR(S) : Wu et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 316 days.

Signed and Sealed this

Sixteenth Day of November, 2010

David J. Kappos

David J. Kappos
*Director of the United States Patent and Trademark Office*